US010791758B2

(12) United States Patent
Fath

(10) Patent No.: US 10,791,758 B2
(45) Date of Patent: Oct. 6, 2020

(54) METHOD FOR MAKING CARTON FOR DISPLAYING ARTICLES ATTACHABLE TO A FLIP SIGN

(71) Applicant: Altria Client Services LLC, Richmond, VA (US)

(72) Inventor: Scott Fath, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 317 days.

(21) Appl. No.: 15/900,055

(22) Filed: Feb. 20, 2018

(65) Prior Publication Data

US 2018/0168221 A1 Jun. 21, 2018

Related U.S. Application Data

(63) Continuation of application No. 14/805,888, filed on Jul. 22, 2015, now Pat. No. 9,930,913.
(Continued)

(51) Int. Cl.
*A24F 15/00* (2020.01)
*B65D 5/42* (2006.01)
(Continued)

(52) U.S. Cl.
CPC ..... *A24F 15/00* (2013.01); *B65B 43/10* (2013.01); *B65B 43/265* (2013.01);
(Continued)

(58) Field of Classification Search
CPC ..... A24F 15/00; A24F 23/00; A47F 5/0846; A47F 7/283; B65B 5/026; B65B 43/10;
(Continued)

(56) References Cited

U.S. PATENT DOCUMENTS 1,574,396 A 2/1926 Hoy
2,465,169 A 3/1949 O'Connor
(Continued)

FOREIGN PATENT DOCUMENTS

DE 1202213 B * 9/1965 ..... B65D 5/5021
FR 983178 A * 6/1951 ..... B65D 5/52
(Continued)

OTHER PUBLICATIONS

Notification of Transmittal of the International Search Report (Forms PCT/ISA/220 and Forms PCT/ISA/210) and the Written Opinion of the International Searching Authority (Forms PCT/ISA/237) dated Oct. 2, 2015, by the European Patent Office in corresponding International Application No. PCT/US2015/041558. (13 pages).

*Primary Examiner* — Stephen F. Gerrity
(74) *Attorney, Agent, or Firm* — Harness, Dickey & Pierce, P.L.C.

(57) ABSTRACT

A carton for displaying articles attachable to a flip sign is disclosed, which includes a box structure having a back panel, a bottom panel, a top panel, a pair of side panels, a top front panel, a bottom front panel, a first inner panel and a second inner panel, the first inner panel having a pair of slots configured to receive a pair of tabs on an outer free edge of the second inner panel. The first and second inner panels rest adjacent to the back panel upon placing a plurality of articles within a recess, which is formed between the top front panel, the bottom front panel, the back panel, and the pair of side panels.

20 Claims, 5 Drawing Sheets

Related U.S. Application Data

(60) Provisional application No. 62/027,504, filed on Jul. 22, 2014.

(51) Int. Cl.

| | |
|---|---|
| ***B65D 5/20*** | (2006.01) |
| ***B65D 5/50*** | (2006.01) |
| ***B65B 43/26*** | (2006.01) |
| ***B65D 5/52*** | (2006.01) |
| ***B65B 43/10*** | (2006.01) |

(52) U.S. Cl.
CPC ..... *B65D 5/2009* (2013.01); *B65D 5/2095* (2013.01); *B65D 5/4208* (2013.01); *B65D 5/5021* (2013.01); *B65D 5/52* (2013.01)

(58) Field of Classification Search
CPC ..... B65B 43/265; B65D 5/20; B65D 5/2004; B65D 5/2009; B65D 5/2095; B65D 5/4208; B65D 5/5021; B65D 5/52
USPC ..... 53/456, 458
See application file for complete search history.

(56) References Cited

U.S. PATENT DOCUMENTS

| | | | | | |
|---|---|---|---|---|---|
| 2,514,384 | A | | 7/1950 | Frankenstein | |
| 2,535,056 | A | | 12/1950 | Frankenstein | |
| 2,781,898 | A | | 2/1957 | Desmond et al. | |
| 2,860,823 | A | | 11/1958 | Frankenstein | |
| 3,021,948 | A | * | 2/1962 | Burge | A47F 5/0846 206/464 |
| 3,381,878 | A | | 5/1968 | Dewhurst | |
| 3,921,895 | A | | 11/1975 | Ziche | |
| 4,116,330 | A | * | 9/1978 | Ellis | B65D 5/4208 229/108 |
| 4,687,094 | A | * | 8/1987 | Allsop et al. | B65D 5/4208 206/45.26 |
| 4,830,185 | A | * | 5/1989 | Colletti | B65D 5/5021 206/449 |
| 5,284,257 | A | * | 2/1994 | Schum | A47F 5/0846 211/128.1 |
| 2004/0250456 | A1 | * | 12/2004 | Welker | G09F 3/204 40/541 |
| 2013/0334096 | A1 | | 12/2013 | Fath | |

FOREIGN PATENT DOCUMENTS

| | | | | | |
|---|---|---|---|---|---|
| FR | 1262021 | A | * | 5/1961 | B65D 5/5021 |
| FR | 86-842 | E | | 4/1966 | |
| JP | 53-2334 | A | | 1/1978 | |

* cited by examiner

METHOD FOR MAKING CARTON FOR DISPLAYING ARTICLES ATTACHABLE TO A FLIP SIGN

CROSS REFERENCE TO RELATED APPLICATION

This application is a continuation application of U.S. patent application Ser. No. 14/805,888, filed Jul. 22, 2015, which claims priority under 35 U.S.C. §119(e) to U.S. Provisional Patent Application No. 62/027,504, filed on Jul. 22, 2014, the entire contents of which are incorporated herein by reference.

SUMMARY

A carton is disclosed capable of holding a plurality of articles is disclosed, comprising: a box structure having a back panel, a bottom panel, a top panel, a pair of side panels, a top front panel, a bottom front panel, a first inner panel and a second inner panel, the first inner panel having a pair of slots configured to receive a pair of tabs on an outer free edge of the second inner panel, and wherein the first and second inner panels rest adjacent to the back panel upon placing a plurality of articles within a recess, which is formed between the top front panel, the bottom front panel, the back panel, and the pair of side panels.

A blank is disclosed for forming a carton, which is operable to contain a plurality of articles is disclosed, the blank comprising: a first inner panel connected to an inner top flap panel along a first edge of the inner top flap panel; a top front panel connected to the inner top flap panel along a second edge of the inner top flap panel; a top panel connected to the top front panel along a first edge of the top panel; a top hinge panel connected to the top panel along a second edge of the top panel; a back panel connected to the top hinge panel along a first edge of the back panel, a left side panel and a right side panel connected along a left side edge and a right side edge of the back panel, respectively; a bottom hinge panel connected to the back panel along a second edge of the back panel; a bottom panel connected to the bottom hinge panel along a first edge of the bottom panel; a bottom front panel connected to the bottom panel along a second edge of the bottom panel; an inside bottom front panel connected to the bottom front panel along a first edge of the inside bottom front panel; an inside bottom panel connected to the inside bottom front panel along a first edge of the bottom front panel; and a second inner panel connected to the inside bottom panel along a second edge of the inside bottom panel.

A blank is disclosed for forming a carton, which is operable to contain a plurality of articles is disclosed, the blank comprising: an inner top flap panel connected to a top front panel along a first edge of the top front panel; a top panel connected to the top front panel along a second edge of the top front panel; a top hinge panel connected to the top panel along a second edge of the top panel; a back panel connected to the top hinge panel along a first edge of the back panel; a bottom hinge panel connected to the back panel along a second edge of the back panel; a bottom panel connected to the bottom hinge panel along a first edge of the bottom panel; a bottom front panel connected to the bottom panel along a second edge of the bottom panel; a lower bottom panel having a plurality of openings, each of the plurality of openings configured to receive a lower portion of a tubular, elongated member, and wherein the lower bottom panel is connected to the bottom front panel along a first edge of the lower bottom panel; an inside bottom panel connected to the lower bottom panel along a second edge of the lower bottom panel; and an upper bottom panel having a plurality of openings, each of the plurality of openings configured to receive an upper portion of a tubular, elongated member, and wherein the upper bottom panel is connected to the inside bottom panel along a first edge of the upper bottom panel.

A method is disclosed for displaying a plurality of articles is disclosed, comprising: assembling a box structure having an open recess on a front portion for receiving a plurality of articles, the box structure having a back panel, a bottom panel, a top panel, a pair of side panels, a top front panel, a bottom front panel, a first inner panel and a second inner panel, the first inner panel having a pair of slots configured to receive a pair of tabs on an outer free edge of the second inner panel, and wherein the first and second inner panels rest adjacent to the back panel upon placing a plurality of articles within the open recess, which is formed between the top front panel, the bottom front panel, the back panel and the pair of side panels; placing one or more articles in the open recess; and securing the assembled box structure adjacent to a flip sign.

DETAILED DESCRIPTION

Figure 1:
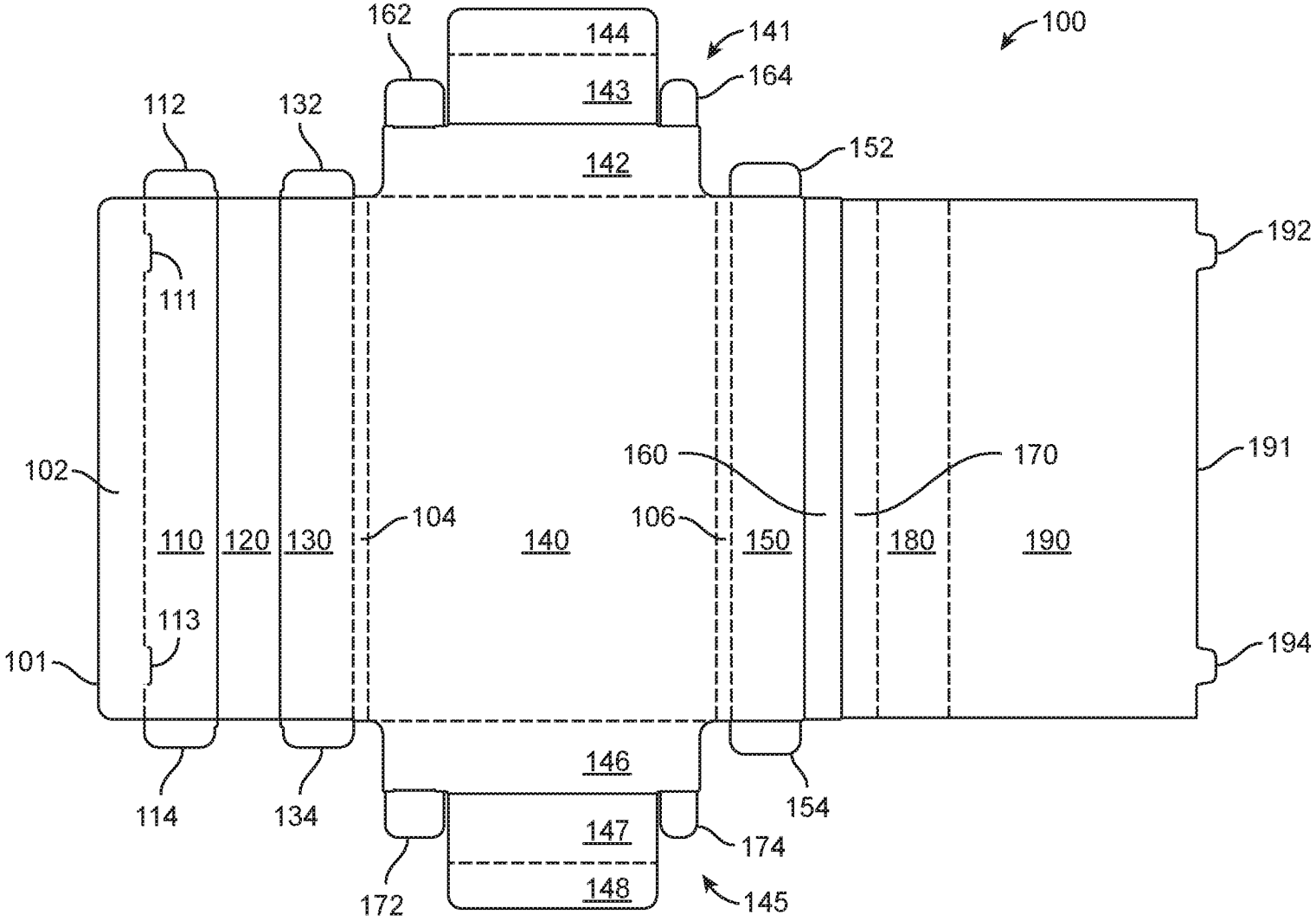
FIG. 1 is a frontside of a blank for forming a carton in accordance with an exemplary embodiment.

In accordance with an exemplary embodiment, a blank 100, 200, and 300 (FIG. 1-3) for forming a carton 400 (FIGS. 4 and 5) operable to contain a plurality of articles or products 500 is disclosed. The carton 400 can be configured to hold a variety of products, for example, cigar boxes, cigarette boxes, liquid cartomizers, and/or electronic cigarette boxes. Advantageously, the carton 400 can use space that is not usually used for retail products. In accordance with an exemplary embodiment, the carton 400 is designed to attach to a flip sign 600 and retain product 500 when the flip sign 600 is rotated upward, which allows access to products that is stored behind the flip sign 600.

In accordance with an exemplary embodiment, a blank 100 for forming a carton 400 (FIG. 4), which is operable to contain a plurality of products 500 is shown in FIG. 1. As shown in FIG. 1, the blank 100 includes a first inner panel 102, which is connected to an inner top flap panel 110 along a fold line to first edge of the inner top flap panel 110. The first inner panel 102 has a free edge 101. A top front panel 120 is connected along a fold line to the inner top flap panel 110 along a second edge of the inner top flap panel 110. A top panel 130 is connected along a fold line to the top front panel 120 along a first edge of the top panel 130. A top hinge panel 104 is connected along a fold line to the top panel 130 along a second edge of the top panel 130. A back panel 140 is connected along a fold line to the top hinge panel 104 along a first edge of the back panel 140. The back panel 140 has a left side panel 141 and a right side panel 145, which are connected along a fold line on a left side edge and a right side edge of the back panel 140, respectively. In accordance with an exemplary embodiment, the left side panel 141 and a right side panel 145 comprises a side panel 142, 146, an inner flap 143, 147, an outer hinge flap 144, 148, and one or more dust flaps 162, 164, 172, 174, respectively. A bottom hinge panel 106 is connected along a fold line to the back panel 140 along a second edge of the back panel 140.

In accordance with an exemplary embodiment, a bottom panel 150 is connected along a fold line to the bottom hinge panel 106 along a first edge of the bottom panel 150. A bottom front panel 160 is connected along a fold line to the bottom panel 150 along a second edge of the bottom panel 150. An inside bottom front panel 170 is connected along a fold line to the bottom front panel 160 along a first edge of the inside bottom front panel 170. An inside bottom panel 180 is connected along a fold line to the inside bottom front panel 170 along a first edge of the inside bottom panel 180, and a second inner panel 190 is connected to the inside bottom panel 180 along a second edge of the inside bottom panel 180.

In accordance with an exemplary embodiment, the inner top flap panel 110, the top panel 130, and the bottom panel 150, each include a left dust flap and a right dust flap, respectively, 112, 114, 132, 134, 152, 154. A fold line between the first inner panel 102 and the inner top flap panel 110 includes a pair of slots 111, 113 configured to receive a corresponding tab 192, 194 on an outer free edge 191 of the second inner panel 190. As shown in FIG. 1, the pair of tabs 192, 194 are located on the outer free edge 191 of the second inner panel 190.

In accordance with an exemplary embodiment, the frontside of the blank 100 as shown in FIG. 1 is folded into the page. In accordance with an exemplary embodiment, as disclosed herein, each of the panels of the blank 100 can be separated from an adjacent panel by a fold or hinge line. In addition, one or more of the hinge or fold lines can be a plurality of perforations extending from one edge of the blank 100 to another edge of the blank 100.

In accordance with an exemplary embodiment, the assembly of the carton 400 from a blank 100 shown in FIG. 1, comprises the folding of the left side panel 141 and the right side panel 145 inward about the left and right side edges of the blank 100. The left side panel 141 and the right side panel 145, which are connected along a left side edge and a right side edge of the back panel 140 each comprises the side panels 142, 146, the inner flaps 143, 147 having a hinge line, and an outer hinge flap 144, 148 are folded about over 180 degrees to form a left and right side panel, respectively.

In accordance with an exemplary embodiment, the blank 100 is folded into the page and forms a carton 400 having a top front panel 120, a top panel 130, a back panel 140, a bottom panel 150, and bottom front panel 160. In accordance with an exemplary embodiment, the top and bottom hinge panels 104, 106 are glued to the frontside of the back panel 140. The corresponding top panels 102, 110, 120, and 130, the bottom panels 150, 160, 170, 180, and 190, and each of the individual panels of the left and right side panels 141 and 145 are folded inward forming a box structure 410 having a frontal recess 420.

In accordance with an exemplary embodiment, dust flaps 112, 132, 152, 162, and 164 are folded inward about the left side panel 141 of the box structure 410. In addition, dust flaps 114, 134, 154, 172, and 174 are folded inward about the right side panel 145 of the box structure 410.

Figure 2:
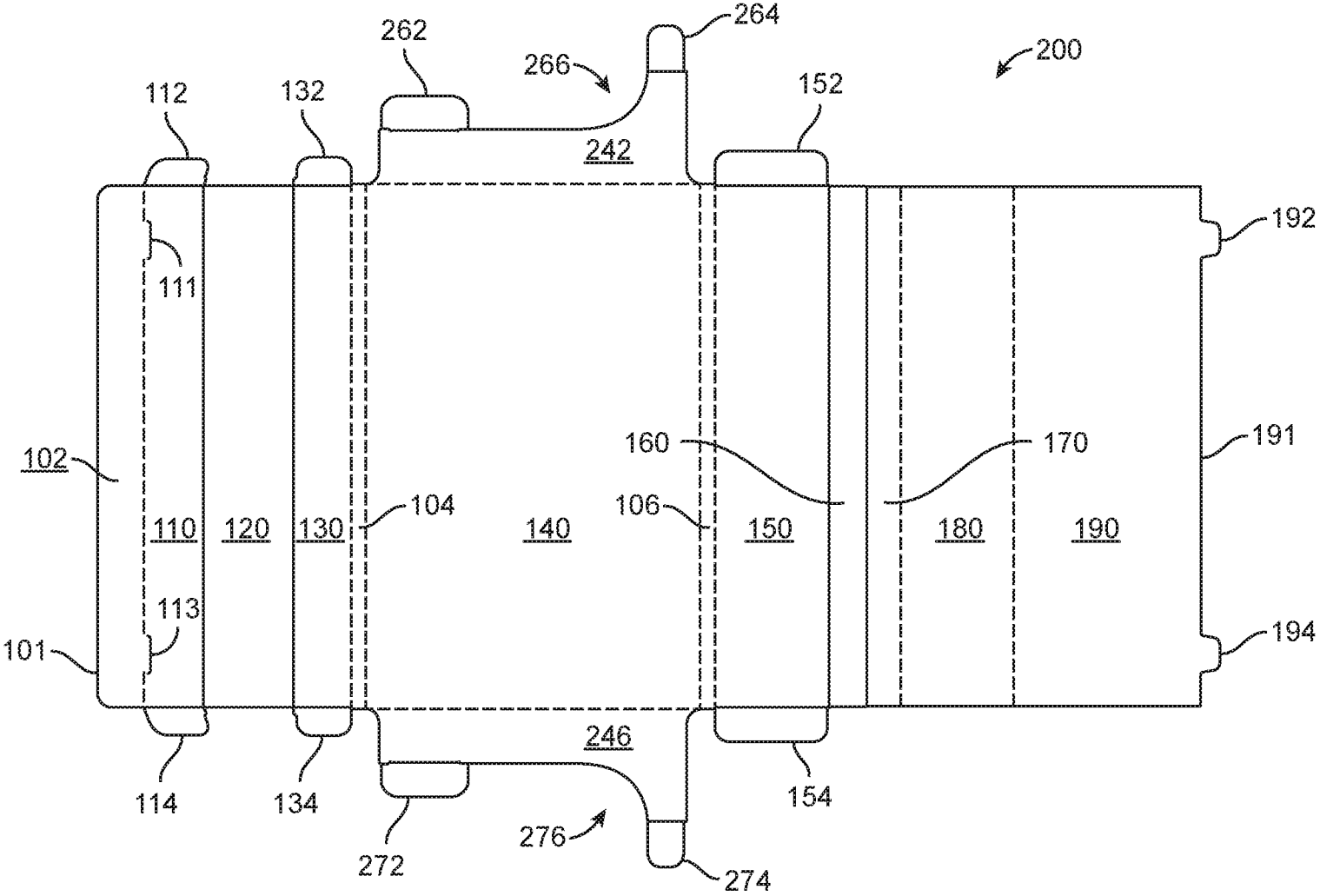
FIG. 2 is a frontside of a blank for forming a carton in accordance with an exemplary embodiment.

FIG. 2 is a frontside of a blank 200 for forming a carton in accordance with an exemplary embodiment. As shown in FIG. 2, the blank 200 includes a first inner panel 102, which is connected to an inner top flap panel 110 along a first edge of the inner top flap panel 110. A top front panel 120 is connected to the inner top flap panel 110 along a second edge of the inner top flap panel 110. A top panel 130 is connected to the top front panel 120 along a first edge of the top panel 130. A top hinge panel 104 is connected to the top panel 130 along a second edge of the top panel 130. A back panel 140 is connected to the top hinge panel 132 along a first edge of the back panel 140, the back panel 140 having a left side panel 242 and a right side panel 246 is connected along a left side edge and a right side edge of the back panel 140, respectively. A bottom hinge panel 106 is connected to the back panel 140 along a second edge of the back panel 140.

A bottom panel 150 is connected to the bottom hinge panel 106 along a first edge of the bottom panel 150. A bottom front panel 160 is connected to the bottom panel 150 along a second edge of the bottom panel 150. An inside bottom front panel 170 is connected to the bottom front panel 160 along a first edge of the inside bottom front panel 170. An inside bottom panel 180 is connected to the inside bottom front panel 170 along a first edge of the inside bottom panel 180, and a second inner panel 190 is connected to the inside bottom panel 180 along a second edge of the inside bottom panel 180.

In accordance with an exemplary embodiment as shown in FIG. 2, the inside top front panel 110, the top panel 130, and the bottom panel 150, each include a left dust flap and a right dust flap, respectively, 112, 114, 132, 134, 152, 154. A fold line between the first inner panel 102 and the inside top front panel 110 includes a pair of slots 111, 113 configured to receive a corresponding tab 192, 194 on an outer free edge 191 of the second inner panel 190. As shown in FIG. 2, the pair of tabs 192, 194 are located on the outer free edge 191 of the second inner panel 190. The first inner panel 102 has a free edge 101.

The blank 200 also includes a left side panel 242 and the right side panel 246, which are connected along a left side edge and a right side edge, respectively, of the back panel 140. In accordance with an exemplary embodiment, each of the side panels 242, 246 has a greater depth on an edge adjacent to the bottom hinge panel 106 than a depth adjacent to the top hinge panel 104. As shown in FIG. 2, each of the side panels 242, 246 has a curved inner edge 266, 276 extending in a direction from the top panel 130 to the bottom panel 150.

Upon assembly of the blank 200 into a carton 400, the bottom of the carton 400 has a greater depth than the top of the carton 400. In addition, as shown in FIG. 2, the bottom panel 150 has a greater depth than the top panel 130. In accordance with an exemplary embodiment, upon assembly of the carton 400, the curved inner edges 266, 276 extend from a front edge of the bottom panel 150 to a front edge of the top panel 160. The left side panel and the right side panels 242, 246 also each include a pair of dust flaps 262, 264, 272, 274 on an outer free edge of the side panels 242, 264. In accordance with an exemplary embodiment, the top and bottom hinge panels 104, 106 are glued to the frontside of the back panel 140.

Figure 3:
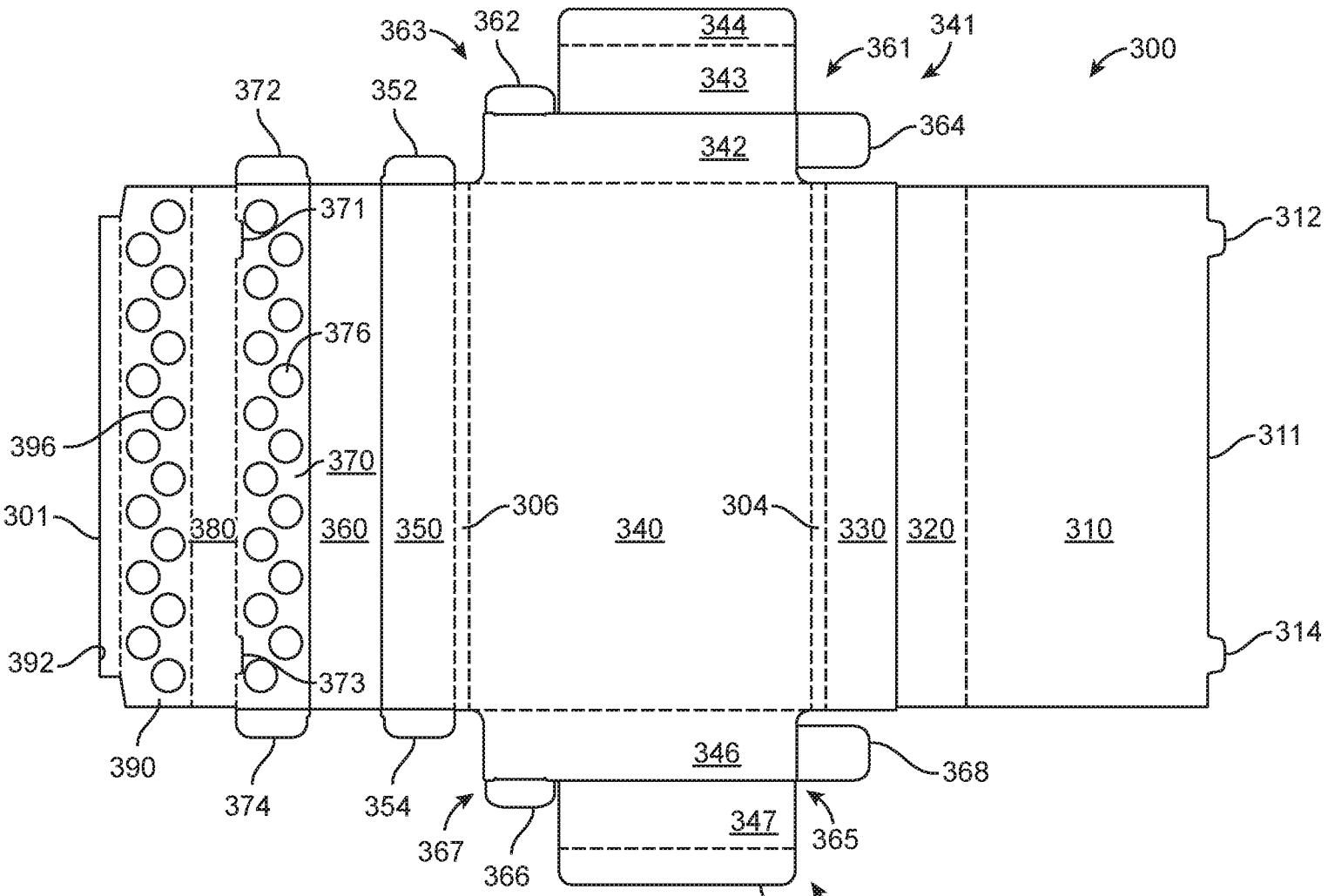
FIG. 3 is a frontside of a blank for forming a carton in accordance with an exemplary embodiment.

FIG. 3 is a blank 300 for forming a carton in accordance with another exemplary embodiment. As shown in FIG. 3, the blank 300 includes an inner top flap panel 310 connected along a fold line to top front panel 320. The top front panel 320 is connected along a fold line to a top panel 330 along a second edge of the top front panel 320. The top front panel 320 is connected along a fold line to a first edge of the top panel 330. A top hinge panel 304 is connected along a fold line to the top panel 330 along a second edge of the top panel 330. A back panel 340 is connected along a fold line to the top hinge panel 304 along a first edge of the back panel 340, the back panel 340 having a left side panel 341 and a right side panel 345, which are connected along a fold line to a left side edge and a right side edge of the back panel 340, respectively. A bottom hinge panel 306 is connected along a fold line to the back panel 340 along a second edge of the back panel 340.

In accordance with an exemplary embodiment, a bottom panel 350 is connected along a fold line to the bottom hinge panel 306 along a first edge of the bottom panel 350. A bottom front panel 360 is connected along a fold line to the bottom panel 350 along a second edge of the bottom panel 350. A lower bottom panel 370 is connected along a fold line to the bottom front panel 360 along a first edge of the lower bottom panel 370. The lower bottom panel 370 has a plurality of openings 376, each of which is configured, for example, to receive one or more tubular, elongated members (not shown). An inside bottom panel 380 is connected along a fold line to the lower bottom panel 370 along a second edge of the bottom front panel 370, and an upper bottom panel 390 having a plurality of openings 396 configured to receive a tubular, elongated member is connected to the inside bottom panel 380 along a second edge of the inside bottom panel 380. The blank 300 also includes a bottom tuck panel 392 connected along a fold line to the upper bottom panel 390.

The plurality of openings 376, 396 can be arranged in two or more rows of openings 376, 396. The plurality of openings 376 within the lower bottom panel 370 and the plurality of openings 396 within the upper bottom panel 390 are configured to align within one another during assembly of the carton 400. In accordance with an exemplary embodiment, the plurality of openings 376, 396 are configured to be offset from one another within each of the panels 370, 390. The carton 400 can be configured to hold 5 to 25 tubular, elongated members (or tubes). For example, as shown in FIG. 3, the blank 300 has 15 openings 376, 396, which are configured to receive 15 tubular, elongated members or tubes.

The blank 300 also includes a left side panel 341 and a right side panel 345, which are connected along a left side edge and a right side edge of the back panel 340. Each of the side panels 341, 345 includes an inner side panel 342, 346, an inner flap 343, 347, and an outer hinge flap 344, 348. Each of the inner side panels 342, 346 also includes a pair of dust flaps 362, 364, 366, 368, which are positioned on a top edge 361, 365 and a lower outer edge 363, 367 of the inner side panels 342, 346.

In accordance with an exemplary embodiment, the bottom panel 350 and the lower bottom panel 370 each include a left dust flap and a right dust flap 352, 354, 372, 374. A fold line between the lower bottom panel 370 and the inside bottom panel 380 includes a pair of slots 371, 373 configured to receive a corresponding tab 312, 314 on an outer free edge 311 of the top flap panel 310.

In accordance with an exemplary embodiment, the blank 300 as shown in FIG. 3 is folded into the page. In accordance with an exemplary embodiment, each of the panels of the blank 300 can be separated from an adjacent panel by a fold or hinge line. In addition, one or more of the hinge or fold lines can be a plurality of perforations extending from one edge of the blank 300 to another edge of the blank 300. In accordance with an exemplary embodiment, the top hinge panel 304 and the bottom hinge panel 306 are glued to the frontside of the back panel 340 during assembly.

In accordance with exemplary embodiment, the blank 100, 200, 300 is formed of a material selected from the group consisting of cardboard, paperboard, plastic, metal, or combinations thereof. For example, in a preferred embodiment, the blank 100, 200, 300 is formed of cardboard having a weight ranging from about 100 grams per square meter to about 350 grams per square meter. In accordance with another exemplary embodiment, the blank 100, 200, 300 includes one or more of printing, embossing, debossing, embellishments, and combinations thereof on an outer surface of the blank 100, 200, and 300.

In the preferred embodiment, the blank 100, 200, 300 may be formed from any suitable materials including, but not limited to, cardboard, paperboard, plastic, metal, or combinations thereof. Preferably, the blank 100, 200, 300 is formed from one or more folded laminar cardboard blanks. Also preferably, the cardboard has a weight ranging from about 100 grams per square meter (gsm) to about 350 grams per square meter.

In accordance with an exemplary embodiment, the blank 100, 200, 300 has a height of about 50 cm to 70 cm, and more preferably about 60 cm to 65 cm from a free edge 101, 301 of the first inner panel 102 or the bottom tuck panel 392 to the free edge 191, 311 of the second inner panel 190 or an inner top flap panel 310. In accordance with an exemplary embodiment, the blank 100, 200, 300 has a width of about 45 cm to about 50 cm in an unassembled state. In accordance with an exemplary embodiment, the carton 400 in an assembled state has a width of about 25 cm to about 30 cm, a height of about 17 cm to about 20 cm, and a depth of about 3 cm to about 7 cm. For example, in accordance with an embodiment shown in FIG. 2, the assembled carton 400 can have a width of about 28 cm to 29 cm, a height of about 18 cm to 19 cm and a depth of about 6 cm to 7 cm on lower or bottom portion thereof, and about 3 cm to 4 cm on a top portion thereof.

Figure 4:
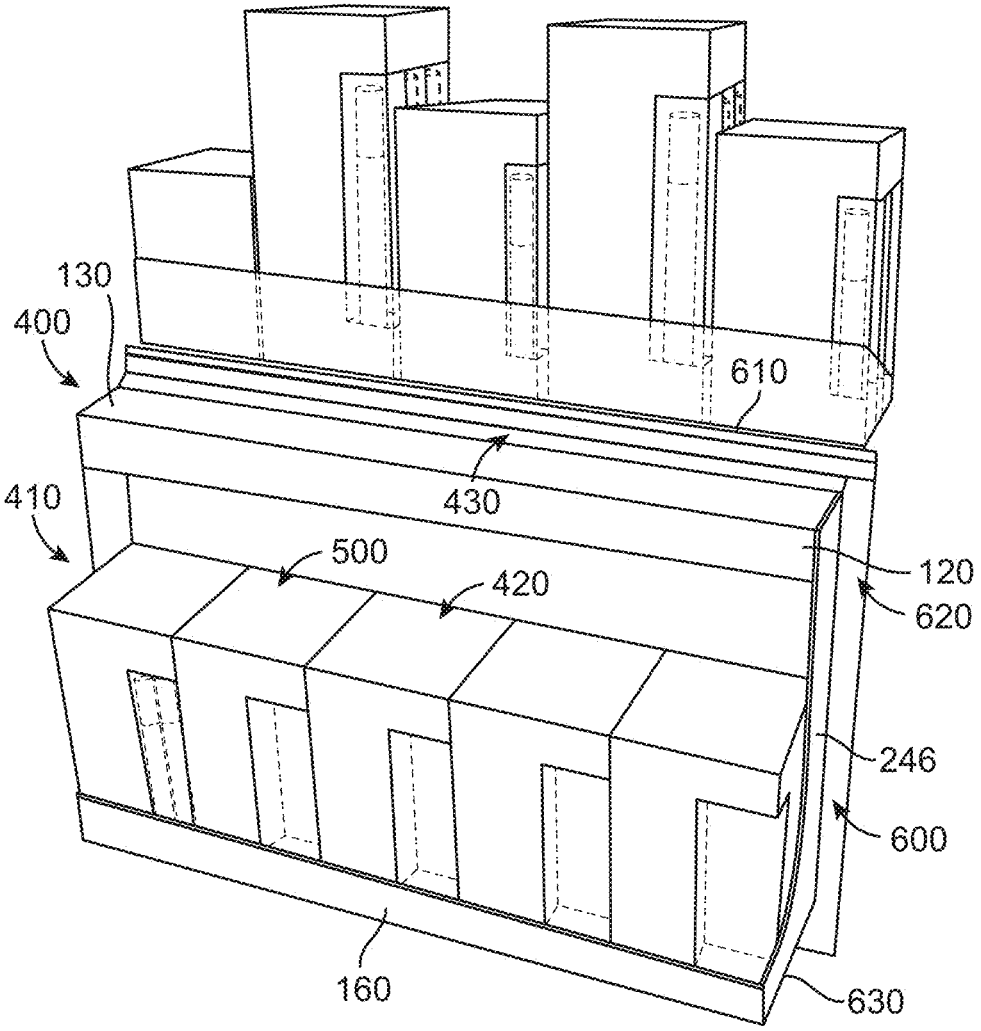
FIG. 4 is a perspective view of an assembled carton on a flip sign in accordance with an exemplary embodiment.
Figure 5:
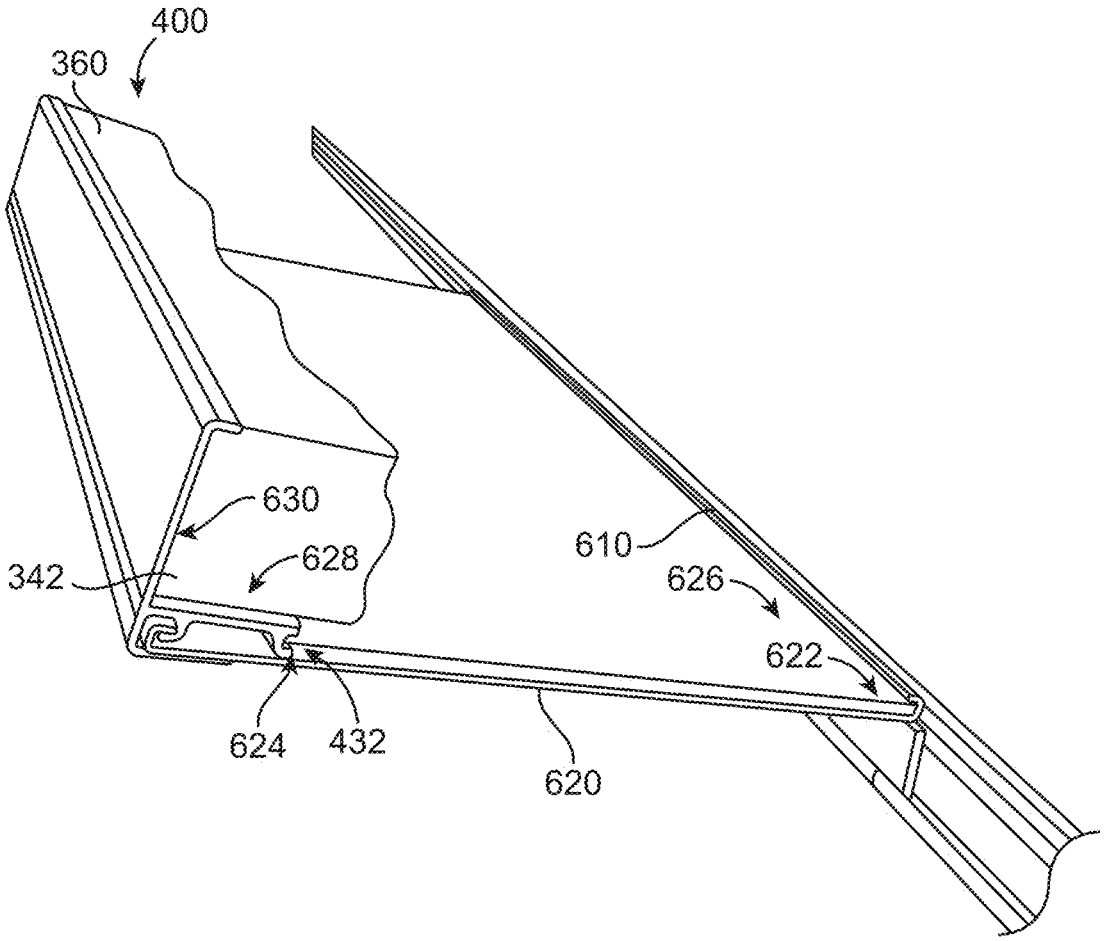
FIG. 5 is a perspective view of an assembled carton on a flip sign in accordance with an exemplary embodiment.

FIGS. 4 and 5 are perspective views of an assembled carton 400 on a flip sign 600 in accordance with an exemplary embodiment. As shown in FIGS. 4 and 5, the carton 400 can be configured to fit or slide onto a flip sign 600 in place of a marketing or advertising sign or placard (not shown). The flip sign 600 is preferably pivotally supported on a store rack or shelving, which houses additional product, which is not on display. In use, the flip sign 600 can be rotated upward to access the store rack or shelving behind the flip sign 600.

In accordance with an exemplary embodiment, the flip sign 600 preferably includes a hinge 610 and a front panel 620. The front panel 620 of the flip sign 600 can also include a pair of slots 622, 624 configured to receive marketing and/or advertising materials in the form of a cardboard or plastic sign or placard (not shown). In accordance with an exemplary embodiment, the assembled carton 400 includes a pair of flanges 430, 432 formed on a backside of the carton 400 by the top hinge panel 104, 304 and the bottom hinge panel 106, 306, respectively. The pair of flanges 430, 432 on the carton 400 is configured to engage the slots 622, 624 on an upper end 626 and a lower end 628, respectively of the flip sign 600, which secures the carton 400 to a frontside of the flip sign 600 (the depiction of the carton 400 in FIG. 5 is truncated to better depict the flip sign 600).

In accordance with an exemplary embodiment, the carton 400 can be configured to hold one or more articles (or packs) 500, for example, cigars, cigarettes, liquid cartomizers and/or e-cigarette boxes. For example, the carton 400 can be configured to hold a thin boxed product, such a 5 (five) pack cigar box or liquid cartomizer, or alternatively, a deep boxed product, such as a cigar box for 25 (twenty-five) cigars or electronic charging kits.

In accordance with an exemplary embodiment as shown in FIG. 5, the flip sign 600 can also include an optional lower panel or extrusion 630, which extends perpendicular to the front panel 620. The lower panel or extrusion 630 can be configured to fit within one of the slots 624 within the front panel 620 of the flip sign 600, and is configured to assist in holding the assembled carton 400 on the flip sign 600. In accordance with an exemplary embodiment, the assembled carton 400 can slide into and/or be secured to the lower panel 630 and/or front panel 620 of the flip sign 600 as shown.

In accordance with an exemplary embodiment, the one or more articles or boxes 500 are preferably retained in the recess 420 between the inner top flap panel 110 and the inside bottom panel 180 of the assembled blank 100, 200 as shown in FIGS. 1 and 2, and within the plurality of openings 376, 396 within the lower bottom panel 370 and the upper bottom panel 390 of the blank 300 as shown in FIG. 3. The recess 420 is configured such that the articles 500 are retained within the recess 420 when the flip sign 600 is lifted upward to access the product stored on the shelves behind the flip sign 600.

In the preferred embodiment, exterior surfaces of the carton 400 may be printed, embossed, debossed or otherwise embellished with manufacturer or brand logos, trademarks, slogans and other consumer information and indicia.

As used herein, the terms "front", "back", "upper, "lower", "side", "top", "bottom", "left", "right" and other terms used to describe relative positions of the components of the box refer to the carton 400 in an upright position.

In accordance with an exemplary embodiment, the fold and/or score lines are 2 pt. rule.

As used herein, the term "longitudinal" refers to a direction from bottom to top or vice versa of the carton 400. The term "transverse" refers to a direction perpendicular to the longitudinal direction.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines can include: a score line, such as lines formed with a blunt scoring knife, or the like, which creates a crushed portion in the material along the desired line of weakness. In addition, cut line extends partially into and/or completely through the material along the desired line of weakness so as to separate one portion of a panel or panels from another portion of a panel or panels.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity a box. Moreover, it will also be apparent to those skilled in the art that various modifications, substitutions, variations, and equivalents exist for claimed features of container. Accordingly, it is expressly intended that all such modifications, substitutions, variations, and equivalents for claimed features of the container, which fall within the spirit and scope of the invention as defined by the appended claims, be embraced thereby.

What is claimed is:

1. A method for displaying one or more articles, comprising:

assembling a box structure to form an assembled box, having a back panel, a bottom panel, a top panel, a left side panel, a right side panel, a top front panel, a bottom front panel, a first inner panel and a second inner panel, the first inner panel including a pair of slots configured to receive a pair of tabs on an outer free edge of the second inner panel, the first inner panel and the second inner panel being adjacent to the back panel, the top front panel, the bottom front panel, the back panel, the left side panel and the right side panel of the assembled box at least partially defining an open recess;

placing the one or more articles in the open recess; and securing the assembled box adjacent to a flip sign.

2. The method of claim 1, wherein the assembling of the box structure includes folding a blank to form the assembled box, the folding of the blank including, folding a first outer hinge flap and a first inner flap on a first side panel to form the left side panel, folding a second outer hinge flap and a second inner flap on a second side panel to form the right side panel, the first side panel and the second side panel each being connected to the back panel.

3. The method of claim 2, wherein the blank further includes a top hinge panel and a bottom hinge panel, and the assembling of the box structure further includes:

gluing the top hinge panel and the bottom hinge panel to a frontside of the back panel.

4. The method of claim 1, wherein the assembling of the box structure includes folding a blank to form the assembled box, and the blank includes:

the first inner panel connected to an inner top flap panel along a first edge of the inner top flap panel;

the top front panel connected to the inner top flap panel along a second edge of the inner top flap panel;

the top panel connected to the top front panel along a third edge of the top panel;

a top hinge panel connected to the top panel along a fourth edge of the top panel;

the back panel connected to the top hinge panel along a fifth edge of the back panel, the back panel connected to the left side panel and the right side panel along a left side edge and a right side edge of the back panel, respectively;

a bottom hinge panel connected to the back panel along a sixth, edge of the back panel;

the bottom panel connected to the bottom hinge panel along a seventh edge of the bottom panel;

the bottom front panel connected to the bottom panel along a eighth edge of the bottom panel;

an inside bottom front panel connected to the bottom front panel along a ninth edge of the inside bottom front panel;

an inside bottom panel connected to the inside bottom front panel along a tenth edge of the inside bottom front panel; and the second inner panel connected to the inside bottom panel along a eleventh edge of the inside bottom panel.

5. The method of claim 4, wherein the blank further includes:

the left side panel and the right side panel being connected to the back panel, the left side panel including a first inner flap between a first side panel and a first outer hinge flap, and the right side panel including a second inner flap between a second side panel and a second outer hinge flap, the first side panel and the second side panel being directly connected to the back panel, the first side panel and the second side panel each including one or more dust flaps.

6. The method of claim 5, wherein the folding of the blank further includes:

folding the one or more dust flaps inward.

7. The method of claim 4, wherein the blank further includes:

a first left dust flap and a first right dust flap on respective ends of the inner top flap panel, a second left dust flap and a second right dust flap on respective ends of the top panel, and a third left dust flap and a third right dust flap on respective ends of the bottom panel.

8. The method of claim 4, wherein the blank further includes a fold line between the first inner panel and the inner top flap panel, the fold line including the pair of slots, the method further comprising;

the folding of the blank further includes inserting the pair of tabs respectively into the pair of slots.

9. The method of claim 8, wherein the blank further includes:

the pair of tabs on an outer free edge of the second inner panel.

10. The method of claim 4, wherein the blank further includes the left side panel and the right side panel each have a curved inner edge extending in a direction from the top panel to the bottom panel, and a bottom portion of the assembled box has a greater depth than a top portion of the assembled box.

11. The method of claim 10, wherein the blank further includes:

a first dust panel on a first outer free edge of the left side panel, and a second dust panel on a second outer free edge of the right side panel.

12. The method of claim 4, wherein the blank further includes:

a first length from the fifth edge of the back panel to the sixth edge of the back panel is greater than a second length from the third edge of the top panel to the fourth edge of the top panel.

13. The method of claim 4, wherein the blank is formed of one of cardboard, paperboard, plastic, metal, or combinations thereof.

14. The method of claim 4, wherein the blank is formed of cardboard having a weight ranging from about 100 grams per square meter to about 350 grams per square meter.

15. The method of claim 4, wherein the blank further includes one of printing, embossing, debossing, embellishments, or combinations thereof, on an outer surface of the blank.

16. The method of claim 4, wherein the blank further includes a lower bottom panel having a first plurality of openings and an upper bottom panel having a second plurality of openings, the folding of the blank further including:

folding the lower bottom panel and the upper bottom panel so that the first plurality of openings are aligned with the second plurality of openings, and the placing of the one or more articles in the open recess including:

sliding the one or more articles into the first plurality of openings and the second plurality of openings that are aligned, the one or more articles each being tubular in shape.

17. The method of claim 16, wherein the first plurality of openings and the second plurality of openings each include two or more rows of openings.

18. The method of claim 1, wherein the assembled box has a width of about 25 cm to about 30 cm, a height of about 17 cm to about 20 cm, and a depth of about 3 cm to about 7 cm.

19. The method of claim 1, wherein the securing of the assembled box includes:

removing a placard from the flip sign by sliding the placard out of a pair of slots in the flip sign, and sliding the assembled box into the pair of slots in the flip sign.

20. The method of claim 1, wherein the placing includes:

placing packs of cigars or packs of cigarettes in the open recess, the packs of cigars or the packs of cigarettes being the one or more articles.

* * * * *